US005398486A

United States Patent [19]

Kauss et al.

[11] Patent Number: 5,398,486

[45] Date of Patent: Mar. 21, 1995

[54] TUBULAR BAGGING MACHINE FOR THE CONTINUOUS MANUFACTURE OF BAGS HAVING FOLDED SIDES

[75] Inventors: Wolfgang Kauss, Gruenberg; Werner Schneider, Hohenahr, both of Germany

[73] Assignee: Rovema Verpackungsmaschinen GmbH, Fernwald-Annerod, Germany

[21] Appl. No.: 73,115

[22] Filed: Jun. 7, 1993

[30] Foreign Application Priority Data

Jun. 6, 1992 [DE] Germany ..... 42 18 810.5

[51] Int. Cl.[6] ..... B65B 9/06

[52] U.S. Cl. ..... 53/551; 53/436; 53/552; 53/451; 493/189; 493/206; 493/209

[58] Field of Search ..... 53/436, 437, 449, 451, 53/551, 552, 564; 409/189, 203, 206, 209, 319

[56] References Cited

U.S. PATENT DOCUMENTS

| | | | |
|---|---|---|---|
| 4,079,662 | 3/1978 | Puccetti et al. | 53/552 |
| 4,391,081 | 7/1983 | Kovacs | 53/436 |
| 4,815,253 | 3/1989 | Kovacs et al. | 53/436 |

FOREIGN PATENT DOCUMENTS 0226693 6/1989 European Pat. Off. .

4005078 8/1991 Germany .

*Primary Examiner*—W. Donald Bray

*Attorney, Agent, or Firm*—Flynn, Thiel, Boutell & Tanis

[57] ABSTRACT

A tubular-bag packaging machine having at least one pair of cross-sealing jaws (25) which are supported on a holding device (15) movable vertically back and forth by means of a connecting rod (14) as well as horizontally through a four-bar mechanism comprising a crank disk (9) coupled with the connecting rod (14), and comprising side-fold-forming means (23, 24) which are supported on a guide element (18) movable transversely with respect to the direction of movement of a foil tube (41). In order to be able reliably synchronize the movement of the side-fold-forming tools (23, 24) with the sequence of movement of the remaining tubular-bag packaging machine, in particular the cross-sealing jaws (25), the invention provides that the guide element (18) is supported on the holding device (15), that the guide element (18) is coupled with an arm (39) pivotally supported on the holding device (15), which arm (39) is operatively connected to a rocker arm (33) pivotally supported on the connecting rod (14) and the lower end area of which cooperates in the area of the crank disk (9) with a cam element (11) associated with the crank disk (9).

14 Claims, 4 Drawing Sheets

FIG. 1
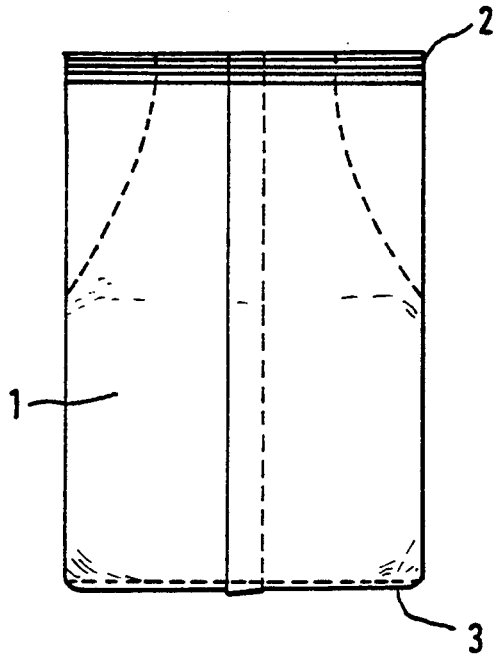
FIG. 1a
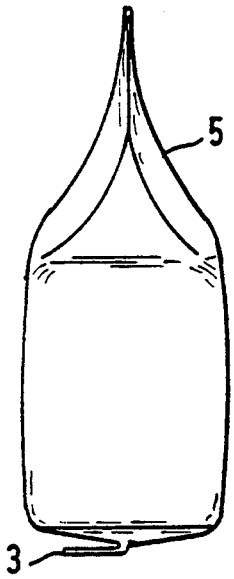
FIG. 1b
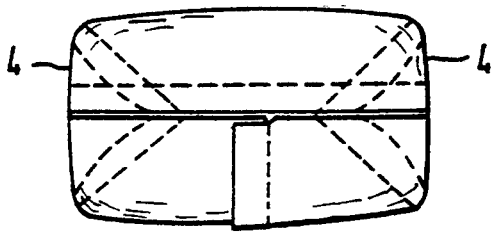
FIG. 1c

TUBULAR BAGGING MACHINE FOR THE CONTINUOUS MANUFACTURE OF BAGS HAVING FOLDED SIDES

FIELD OF THE INVENTION

The invention relates to a tubular bagging machine for the manufacture of packages having folded sides, with the packages being made of a sheet-like material which is formed into a continuous tube by means of a forming shoulder with the subsequent forming of a longitudinal seam, with the top and bottom seam being formed by means of at least one pair of cross-welding/-cross-sealing jaws which rotate cyclically on approximately circular paths and are guided parallel with respect to one another, with a crank disk coupled with a connecting rod, and with side-fold-forming means which are supported on a guide element movable transversely with respect to the direction of movement of a foil tube.

BACKGROUND OF THE INVENTION

The manufacture of tubular bags on forming, filling and sealing machines is known for example from U.S. Pat. No. 4,391,081. The rotating friction belts which rest on a fill pipe pull the foil sheet supplied by a roller over a forming shoulder, with the initially flat foil being formed into a tube. The longitudinal seam is formed by sealing or welding of the overlapping edges. The forming shoulder has a fill pipe so that the goods to be packaged can be filled from above through the fill pipe into the tube. The bottom seam and at the same time the top seam of the preceding bag are created below the fill pipe by means of a cross-sealing station, with the two bags being separated from one another by means of a separating knife. The cross-sealing jaws, which lie transversely with respect to the direction of movement of the bag material, are here moved cyclically in one plane in order to be able to move the filled bag on downwardly after sealing.

A tubular bagging machine operating in this manner has become known from U.S. Pat. No. 4,815,253 which shows a device for the manufacture of upstanding bags. The sidewalls are folded inwardly below and above the sealing jaws shortly before the sealing by means of side-fold-forming means. The bag is moved downwardly after the sealing has taken place, with the bag being one more time shaped into a rectangular shape in a forming chamber consisting of two oppositely lying U-shaped elements prior to its top seam being formed and prior to the separation from the next following bag taking place.

Part of the state of the art is also to support the rectangular shape of the bag to be manufactured such that the fill pipe itself has, at least in the lower area, a rectangular cross section. However, it is also known to design the entire pipe rectangularly, with the forming shoulder changing the flat sheet into a rectangular tube.

It is disadvantageous in these intermittently operating packaging machines that, based on the standstill times of the cross-sealing jaw movement and of the unwinding foil, an upper limit exists for the machine performance. In particular, and due to the very fast foil acceleration, the frictional resistance between foil and friction belt is no longer guaranteed so that, due to slippage, the adjusted bag length can no longer be achieved.

In order to overcome the disadvantage of the intermittent tubular bagging machine, a continuously operating device is described in EP-PS 226 693. In contrast to the preceding devices, the cover material is continuously removed from the roller, is formed into a tube and is fed to the cross-sealing station. The longitudinal sealing task is also done continuously. The sealing jaws of the cross-sealing station describe in this case an essentially circular path, with significantly faster machine performances being possible due to the elimination of the standstill times of the jaw movement. Due to the linear movement of the control cam and of the movable arrangement of the cross-sealing jaw carrier, a sealing-/welding path results over which the sealing jaws travel synchronously with the foil by a suitable driving control. Only so-called flat bags can be produced with this tubular bagging machine.

The closest state of the art is DE-OS 40 05 078. This reference shows a block base station following the cross-sealing station, which block base station has side-fold-forming tools which are horizontally movably supported. The movement of the tools is controlled through a cam directly associated with the tools. It can be disadvantageous in this known device that the cam cannot be sufficiently synchronized in its rotary speed with the movement of the cross-sealing jaws and the foil tube in order to control the horizontal movement of the side-fold-forming tools. In particular, and in the case of shorter cycle times and faster production speeds, considerable problems can therefore result.

SUMMARY OF THE INVENTION

The purpose of the present invention is to provide a side-folding device for a continuously operating tubular bagging machine which, with a simple design and reliable operation, produces bags able to stand or those with folds formed in their sides.

The device of the invention is characterized by a number of significant advantages. Since the side-folding device is moved in vertical direction synchronously with the cross-sealing jaws, a relative speed does not occur therebetween during the actual sequence of operation. Due to the so created fixed spacial relationship, it is possible to transfer the operation, as it is known for intermittently operating machines, to the continuously operating machines. A satisfactory quality of the bag can in this manner be achieved.

It is of a particular advantage when the vertical movement of the side-folding device and cross-sealing jaws is synchronous during the entire machine cycle since the adjusting and change-over operations are in this manner significantly simplified.

The synchronous movement is achieved in an advantageous development by the drive of the side-folding device being operatively connected to the cross-sealing station. An adjusting of the movements in every operating phase of the tubular bagging machine is guaranteed in particular through a mechanical coupling.

It is of a particular advantage when the vertical movement is produced by a connecting rod, with the vertical direction of movement of the side-folding device being pregiven by means of a guide. With this the number of structural parts is reduced to a minimum.

Also the operating stroke of the side-fold-forming means perpendicularly with respect to the direction of movement of the tube material is mechanically produced in a particularly favorable further development. This makes it possible to operate the entire device without an active drive mechanism, as for example pneumatic cylinders, etc. The adjustment is thus significantly easier and can be carried out also by not specially trained or educated personnel.

A particular advantage is that the device does not need any supply lines for air or electricity so that when the supply is discontinued an unintended collision of structural parts is not possible, which could possibly result in a destruction of the device.

It is also possible according to the invention to mount a forming box below the side-folding device, which box could also be moved up and down in vertical direction synchronously with said side-folding device and with the cross-sealing jaws. The bag can then during the sealing of the top seam be moved again subsequently into a rectangular form.

It is particularly advantageous to support the bag from below with a plate during shaping. Due to the still hot bottom seam, a permanent bending toward the base can be achieved. Thus the bag is particularly sturdy. However, it is also possible to effect the bending of the bottom seam with a stream of air. This would at the same time have the advantage of an improved cooling of the bottom seam and thus of the increased seam sturdiness.

It is of a particular advantage that the device can be adjusted to different radii of the sealing-jaw movement by also adjusting the connecting-rod stroke for the side-folding device to the changed conditions. This is particularly necessary when, in the case of large radii, large bag dimensions are supposed to be manufactured or, in the case of small radii, fast operating speeds of the tubular bagging machine are supposed to be achieved.

It is possible in a particularly advantageous development to adapt the horizontal operating stroke of the side-fold-forming means to the differing dimensions without necessitating a change of the folding tools. Only small readjusting operations are needed for this. The elimination of dimensioning parts guarantees a better handling capability.

Thus both the movement of the cross-sealing jaws and also of the side-fold-forming tools are caused by one single drive, namely, the rotation of the crank disk, in the tubular bagging machine of the invention. Thus it is possible in a particularly simple manner to synchronize the vertical movement of the cross-sealing jaws and the horizontal movement of the side-fold-forming tools. This synchronization thus exists during the entire sequence of movement, not like in similar devices known from the state of the art only at the start and at the end of the respective movement of one operating cycle. Furthermore, it is possible in a particularly simple manner to adjust both the connecting-rod stroke of the holding device, namely, the vertical stroke of the cross-sealing jaws, and also the horizontal stroke of the side-fold-forming tools and the respective bag sizes, cycle speeds and the like.

BRIEF DESCRIPTION OF THE DRAWINGS

The invention will be described hereinafter in connection with one exemplary embodiment and the accompanying drawings, in which:

FIG. 1 includes FIGS. 1*a*, 1*b* and 1*c* which are, respectively, a front view, a side view and a top view of a finished bag with formed folds on the sides and a base;

DETAILED DESCRIPTION

The bag has essentially a rectangular cross section. The top and the bottom seam 2, 3 are folded inwardly from the side surfaces 4. The top area thus forms a gable 5. The bottom area is folded farther inwardly than the top area thus resulting, after the subsequent folding over of the seam, in an almost rectangular base surface enabling the bag to be somewhat able to stand. However, it is also possible to design both the top and also the bottom area like a gable.

Figure 2:
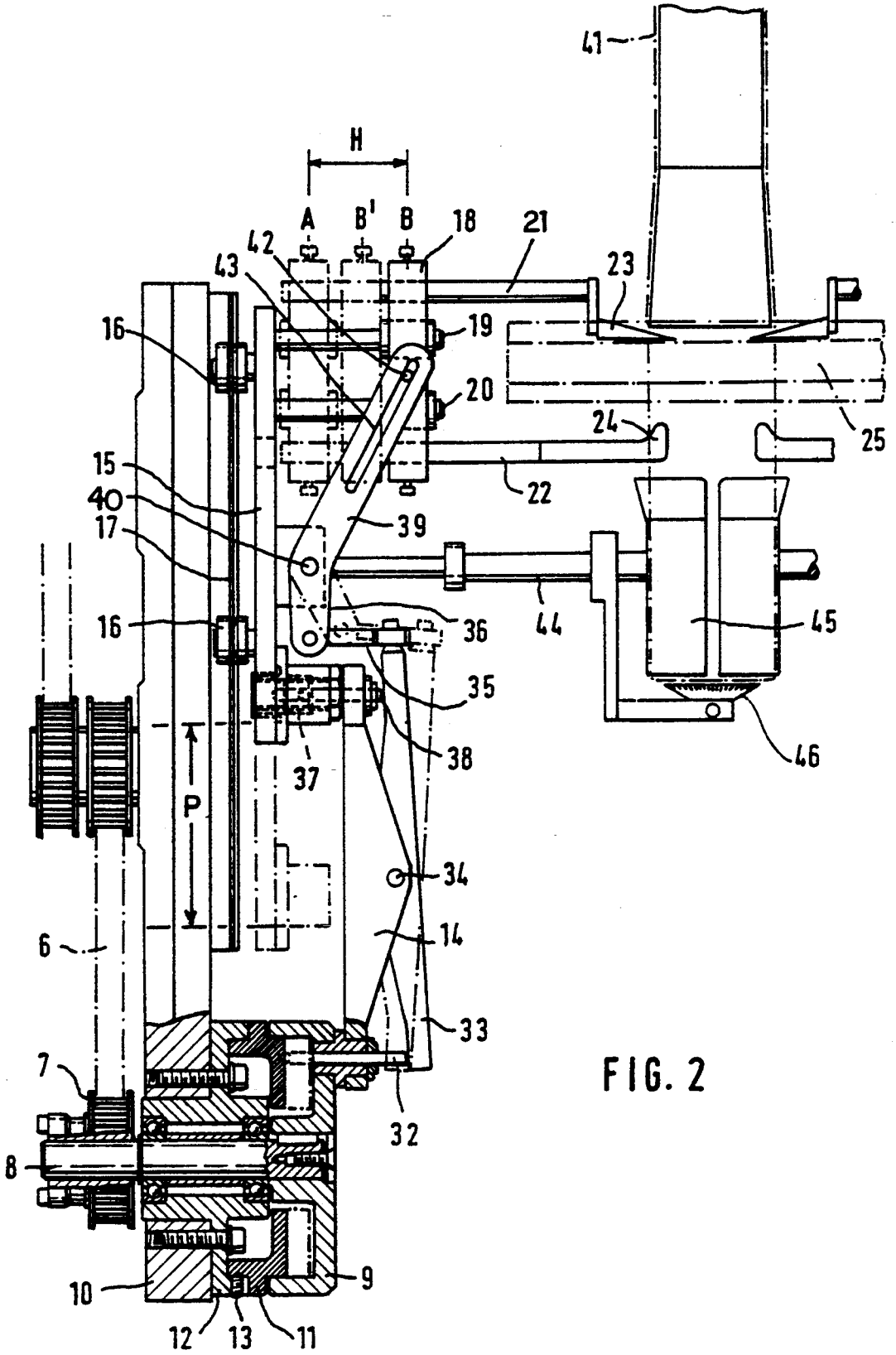
FIG. 2 and FIG. 3 are, respectively, each a front view of the side-folding device.
Figure 3:
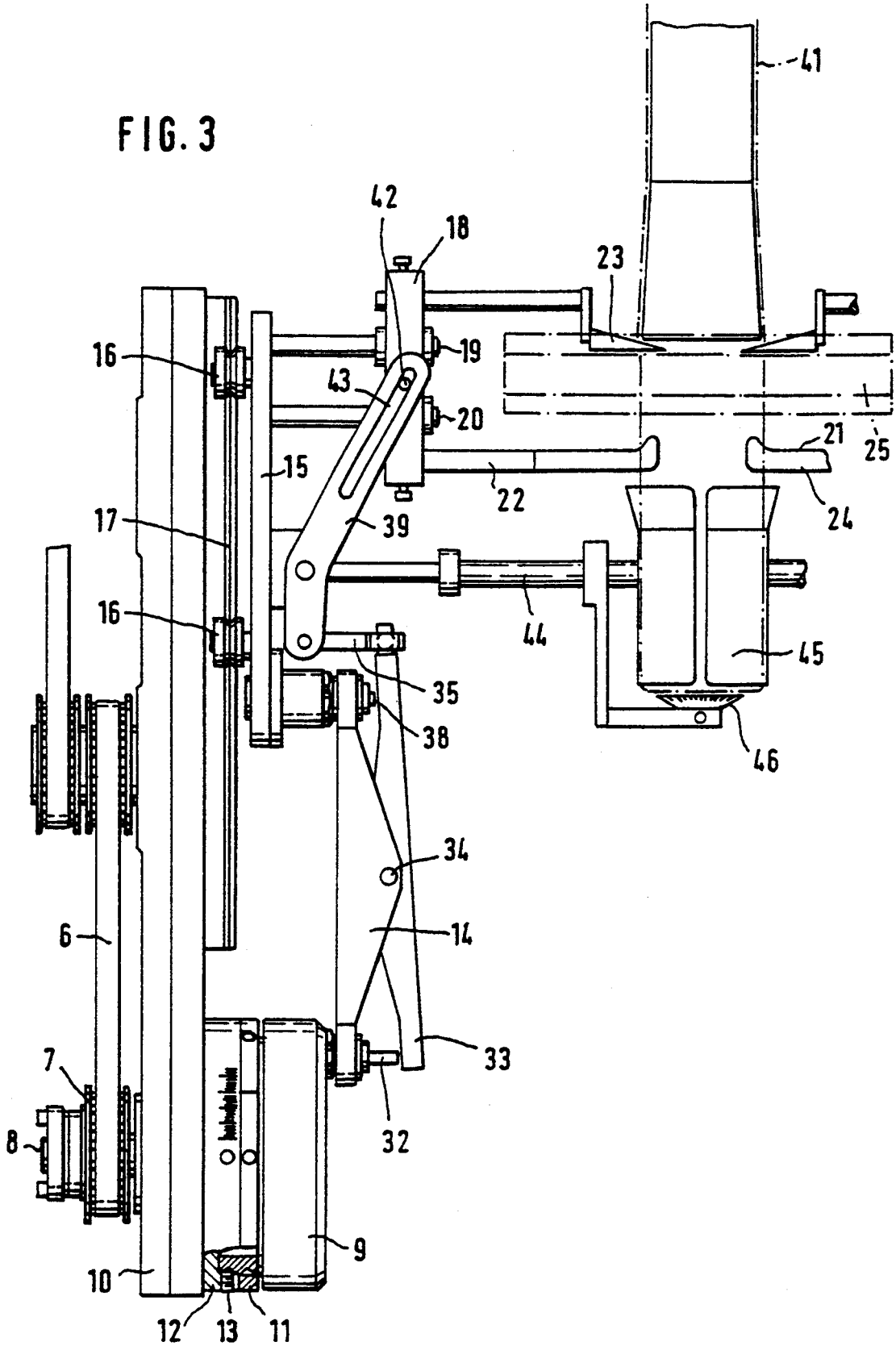

FIGS. 2 and 3 show a front view of the side-folding device of the invention. A toothed belt 6 coming from the main drive drives a crank disk 9 by means of a toothed disk 7 and a shaft 8. The shaft 8 is rotatably supported in a frame 10 which is provided to hold the cross-sealing station and the side-folding device. A cup-shaped cam 11, which in turn is fastened on a holding disk 12, is provided between the frame 10 and the crank disk 9. The cup-shaped cam 11 can be moved in direction of rotation relative to the holding disk 12 and can be fixed in a selected position by means of a clamping screw 13.

A connecting rod 14 is supported on the crank disk and is connected to a holding device 15. The holding device 15 in turn is guided by means of rollers 16 and a guide element 17 in such a manner that only a vertical up and down movement in accordance with the given connecting rod stroke P is possible.

A further guide element 18 and two guide rods 19, 20 are provided on the holding device 15. A holding rod 21, 22 is provided on each of the upper and lower ends of the guide element 18. The side-fold-forming means 23, 24 are arranged on the holding rods 21, 22.

Figure 4:
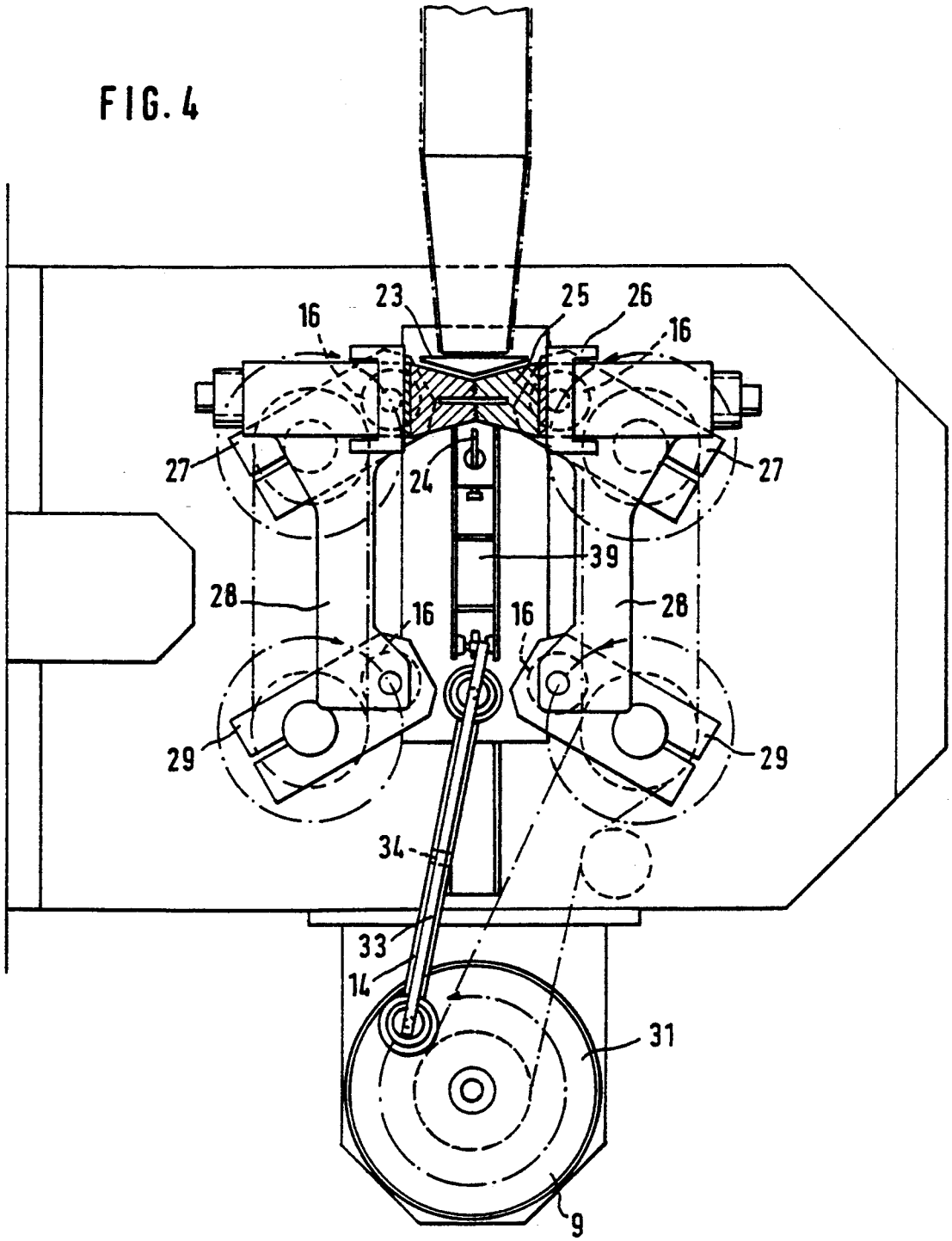
FIG. 4 is a side view of the device of the invention.

FIG. 4 shows the vertical position of the side-fold-forming means 23, 24, each being arranged just above and below the sealing jaw 25.

The cross-sealing jaws are, in the cross-sealing station to be looked at here, each arranged through a carrier 26 on a pair of crank arms 27 which in turn are connected through two connecting guide rods 28 to a second pair of connecting-rod arms 29 for the parallel guiding of the sealing jaws. A parallel guiding of the sealing surfaces is obtained through the thus resulting four-bar mechanism.

Since both the cross-sealing jaws 25 and also the side-folding device are driven by one and the same drive 31, the association in vertical direction, as shown in the drawings, is maintained over one entire operating cycle which makes it impossible for the side-fold-forming means 23, 24 to hit the sealing jaws 25 after a one-time adjustment. With this the highest degree of operating safety is guaranteed.

The stroke H needed to create a side fold is produced by the device of the invention as follows: The pin 32, which is rotatably supported and axially movable in the crank disk 9, rests on a surface of the cup-shaped cam 11 and travels during a rotation of the crank disk 9 along its contour. At the time when the feeding of the side-fold-forming means 23, 24 is supposed to occur, the pin 32 passes a raised area on the cam contour, which causes a movement of the pin in axial direction. A rocker arm 33 rests on the pin 32 outside of the crank disk 9, which rocker arm 33 is pivotally supported on a joint 34. A further coupling joint 35 is arranged on the opposite end, which joint is followed by an arm 36. A pin 38 initially tensioned by means of a spring 37 presses between the joints 34, 35 against the rocker arm 33 and produces in this manner a sufficiently large restoring force for the rocker arm 33 and the bearing force for the cam pin 32.

The initially tensioned spring 37 is further compressed when the operating stroke H is produced. The arm 39, which is pivotally supported on a fulcrum point 40 and is fixedly connected to the arm 36, pivots with its upper part essentially horizontally and in radial direction with respect to the foil tube 41. The guide element 18 is moved from its position A, shown by dashed lines, into the position B through a connecting-link guiding by means of a cam 42 and an elongated recess 43 in the arm 39. After the stroke has been carried out, the sealing jaws 25 close in order to create the sealing seams 2, 3 and to make the separating cut.

The side-fold-forming means 23, 24 are returned into the position A shortly before the separation of the sealing jaws 25. This is done by the pin 32 having passed the raised point on the cup-shaped cam 11 and the arms 33, 36, 39 returning into their initial position based on the restoring force produced by means of the spring 37 and transmitted by the pin 38.

Moreover a further holding tool 44 can be arranged on the holding device, on which holding rod 44 is fastened a U-shaped sheet-metal plate 45. The two oppositely lying sheet-metal plates 45 define a rectangular chute when the side-folding device moves together, which chute in addition lends the bag 1 a rectangular shape.

The sheet-metal plates 45 just like the side-fold-forming means 23, 24 are selected parts and can be exchanged with other such parts when the bag geometry is changed. It is in particular possible to design the bottom seam of a bag with a folded triangle of the conventional type as flat as possible so that a base is created.

If during an exchange of the aforesaid parts the operating stroke H is in need of being changed, then changing the stroke is possible by a vertical shifting of the cam 42 on the guide element so that the guide element is moved into the position B'.

The capability of a bag to stand can be further increased by bending the bottom seam 3 by means of a device 46. The device 46 is arranged below the chute for the bag. A pivotal plate, a blowing device or a combination of both can be used here.

The invention is not to be limited to the shown exemplary embodiment, rather many variations and modifications result for the man skilled in the art within the scope of the invention.

The embodiments of the invention in which an exclusive property or privilege is claimed are defined as follows:

1. In a tubular bagging machine for the manufacture of packages having folded sides, said packages being manufactured of a sheet-like material, said tubular bagging machine having forming shoulder means for continuously converting a sheet-like material into a foil tube having a longitudinally extending seam, at least one pair of cross-welding/cross-sealing jaws for forming vertically spaced top and bottom seals in the foil tube, said jaws each being supported by a support means and driven by drive means for cyclical rotation on generally circular paths, a crank disk, and side-fold-forming means supported on a guide element for movement transversely with respect to the direction of movement of the foil tube by said crank disk driving a connecting rod connected thereto at a first end thereof and at a second end thereof to said side-fold-forming means, the improvement wherein said side-fold-forming means further includes said guide element being supported on a holding device supported for reciprocal movement and having an arm pivotally supported thereon, said guide element further being coupled to a first end of said arm, said connecting rod being connected at said second end thereof to said holding device, a rocker arm pivotally supported on said connecting rod, one end of said rocker arm being operatively connected to said crank disk while also being operatively connected at a second end thereof to a second end of said arm, and a cam element having a contoured surface thereon, said one end of said rocker arm including contoured surface engaging means for causing said rocker arm to move about said pivotal support therefor in accordance with said contoured surface on said cam element to cause said side-fold-forming means to move toward and away from said foil tube to form the folded sides on the package while simultaneously said holding device is moved.

2. The machine according to claim 1, wherein said contoured surface engaging means includes a horizontally movable pin supported on said crank disk in a bearing located on said connecting rod, said pin extending through the crank disk and has one end thereof resting against said contoured surface on said cam element and the other end thereof resting against said rocker arm.

3. The machine according to claim 1, wherein said rocker arm is pivotally supported at its center area by means of a joint on said connecting rod.

4. The machine according to claim 1, wherein a pin, which is initially tensioned by a spring in direction of said second end of said rocker arm and is longitudinally movable, is arranged adjacent a bearing support for effecting the connection of said connecting rod at said second end thereof to said holding device, said pin resting for the initial tensioning of the rocker arm against said rocker arm.

5. The machine according to claim 1, wherein said cam element is designed in the form of a cup-shaped cam fixedly supported on a frame of the packaging machine, said cam being arranged concentrically with respect to said crank disk.

6. The machine according to claim 5, wherein said cam element is relatively rotatably supported on said frame and is fixed by means of a locking mechanism in any desired rotary position relative to said frame.

7. The machine according to claim 1, wherein said arm is coupled with said guide element through an oblong-hole guide in said arm.

8. The machine according to claim 1, wherein said arm is connected to said second end of said rocker arm through a coupling joint having several degrees of freedom.

9. The machine according to claim 1, wherein said crank disk includes stroke adjusting means for adjusting the stroke of said connecting rod.

10. The machine according to claim 1, wherein said holding device includes a means for bending a bottom seam of a bag arranged on said holding device.

11. The machine according to claim 1, wherein said holding device includes a means for shaping a bag into a selected form.

12. The machine according to claim 11, wherein said selected form is rectangular.

13. The machine according to claim 1, wherein said holding device includes means for supporting said holding device for movement in a direction parallel to a direction of movement of said foil tube.

14. The machine according to claim 13, wherein said arm is a two-arm lever, a first arm of said two-arm lever on one side of the pivotal support therefor being connected to said guide element, a second arm of said two-arm lever on a second side of the pivotal support therefor remote from said one side being connected to said second end of said rocker arm.

* * * * *